US009500076B2

(12) United States Patent
Walters et al.

(10) Patent No.: US 9,500,076 B2
(45) Date of Patent: Nov. 22, 2016

(54) INJECTION TESTING A SUBTERRANEAN REGION

(71) Applicant: Halliburton Energy Services, Inc., Houston, TX (US)

(72) Inventors: Harold Grayson Walters, Tomball, TX (US); Ronald Glen Dusterhoft, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 183 days.

(21) Appl. No.: 14/029,247

(22) Filed: Sep. 17, 2013

(65) Prior Publication Data

US 2015/0075777 A1 Mar. 19, 2015

(51) Int. Cl.

| | |
|---|---|
| ***E21B 43/26*** | (2006.01) |
| ***E21B 47/06*** | (2012.01) |
| ***E21B 49/00*** | (2006.01) |

(52) U.S. Cl.

CPC ..... *E21B 49/008* (2013.01); *E21B 43/26* (2013.01); *E21B 47/06* (2013.01)

(58) Field of Classification Search

CPC ..... E21B 49/008; E21B 47/06; E21B 43/267

See application file for complete search history.

(56) References Cited

U.S. PATENT DOCUMENTS

| | | | | |
|---|---|---|---|---|
| 3,273,647 | A | 9/1966 | Briggs, Jr. et al. | |
| 3,722,589 | A | 3/1973 | Smith et al. | |
| 4,749,038 | A * | 6/1988 | Shelley | 166/250.1 |
| 5,005,643 | A | 4/1991 | Soliman et al. | |
| 5,050,674 | A | 9/1991 | Soliman et al. | |
| 5,165,276 | A * | 11/1992 | Thiercelin | 73/152.39 |
| 5,241,475 | A | 8/1993 | Lee et al. | |
| 5,375,658 | A | 12/1994 | Schultz et al. | |
| 5,411,091 | A * | 5/1995 | Jennings, Jr. | 166/280.1 |
| 5,974,874 | A * | 11/1999 | Saulsberry | 73/152.41 |
| 6,002,063 | A * | 12/1999 | Bilak et al. | 588/17 |
| 6,705,398 | B2 * | 3/2004 | Weng | 166/250.1 |
| 7,210,528 | B1 * | 5/2007 | Brannon et al. | 507/140 |
| 7,272,973 | B2 * | 9/2007 | Craig | 73/200 |
| 7,472,751 | B2 * | 1/2009 | Brannon et al. | 166/280.1 |
| 7,774,140 | B2 | 8/2010 | Craig | |
| 7,784,539 | B2 | 8/2010 | Montaron | |
| 7,788,037 | B2 | 8/2010 | Soliman et al. | |
| 7,918,277 | B2 * | 4/2011 | Brannon et al. | 166/280.2 |
| 8,127,850 | B2 * | 3/2012 | Brannon et al. | 166/308.1 |

(Continued)

OTHER PUBLICATIONS

Hamid et al, "Injection System for Microfrac or Step-Rate Testing", SPE Society of Petroleum Engineers, SPE 21267, Oct. 31-Nov. 2, 1990, 6 pages.

(Continued)

*Primary Examiner* — Angela M DiTrani
*Assistant Examiner* — Crystal J Miller
(74) *Attorney, Agent, or Firm* — John W. Wustenberg; Parker Justiss, P.C.

(57) ABSTRACT

In some aspects, an injection rate of an injection test applied to a subterranean region is controlled. The injection test includes a series of injection periods and shut-in intervals. Each of the injection periods is followed by a respective one of the shut-in intervals. The subterranean region is monitored during the injection test.

22 Claims, 6 Drawing Sheets

(56) References Cited

U.S. PATENT DOCUMENTS

| | | | | |
|---|---|---|---|---|
| 8,210,257 | B2 | 7/2012 | Dusterhoft et al. | |
| 8,261,834 | B2 * | 9/2012 | Eslinger | 166/308.1 |
| 8,403,041 | B2 | 3/2013 | Alsop et al. | |
| 8,620,636 | B2 * | 12/2013 | Zhan et al. | 703/10 |
| 2003/0079875 | A1 * | 5/2003 | Weng | E21B 43/26 166/250.07 |
| 2006/0155473 | A1 | 7/2006 | Soliman et al. | |
| 2007/0079652 | A1 * | 4/2007 | Craig | 73/152.22 |
| 2007/0162235 | A1 * | 7/2007 | Zhan et al. | 702/6 |
| 2007/0272407 | A1 | 11/2007 | Lehman et al. | |
| 2008/0032898 | A1 * | 2/2008 | Brannon et al. | 507/100 |
| 2009/0107674 | A1 * | 4/2009 | Brannon et al. | 166/280.2 |
| 2010/0116500 | A1 * | 5/2010 | Brannon | 166/308.1 |
| 2010/0218941 | A1 | 9/2010 | Ramurthy et al. | |
| 2011/0120705 | A1 | 5/2011 | Walters et al. | |
| 2011/0125476 | A1 * | 5/2011 | Craig | 703/10 |
| 2011/0209868 | A1 * | 9/2011 | Dusterhoft | E21B 43/26 166/250.1 |
| 2011/0272159 | A1 * | 11/2011 | Osiptsov et al. | 166/308.1 |
| 2012/0012308 | A1 | 1/2012 | Ziauddin et al. | |
| 2012/0043078 | A1 | 2/2012 | Ziauddin et al. | |
| 2012/0152542 | A1 * | 6/2012 | Le | 166/297 |
| 2013/0000895 | A1 | 1/2013 | Walters et al. | |
| 2014/0182844 | A1 * | 7/2014 | Wutherich | E21B 43/26 166/250.02 |
| 2014/0262232 | A1 * | 9/2014 | Dusterhoft et al. | 166/250.1 |
| 2015/0040657 | A1 * | 2/2015 | Proett et al. | 73/152.51 |
| 2015/0075778 | A1 * | 3/2015 | Walters et al. | 166/250.1 |
| 2015/0075779 | A1 * | 3/2015 | Walters et al. | 166/250.1 |

OTHER PUBLICATIONS

Railroad Commission of Texas, "Injection/Disposal Well Permit Testing and Monitoring Seminar Manual", [retrieved from internet on Sep. 5, 2013], www.rrc.state.tx.us/forms/publications/HTML/fsrt.php, 1 page.

Gidley et al, "Recent Advances in Hydraulic Fracturing", Society of Petroleum Engineers, Published in 1989, (pp. 59-60 and 283), 5 pages.

* cited by examiner

INJECTION TESTING A SUBTERRANEAN REGION

BACKGROUND

The following description relates to injection testing a subterranean region.

Fracture treatments are often used to fracture shale, coal, and other types of rock formations. During a fracture treatment, fluids are pumped into the formation (e.g., through a wellbore) under high pressure, and the pressure of the fluid in the formation fractures the rock. Injection tests are sometimes performed before a fracture treatment. Conventional injection tests include step-rate tests, mini-fracture tests, and diagnostic fracture injection tests (DFIT).

DESCRIPTION OF DRAWINGS

Like reference symbols in the various drawings indicate like elements.

DETAILED DESCRIPTION

Figure 1A:
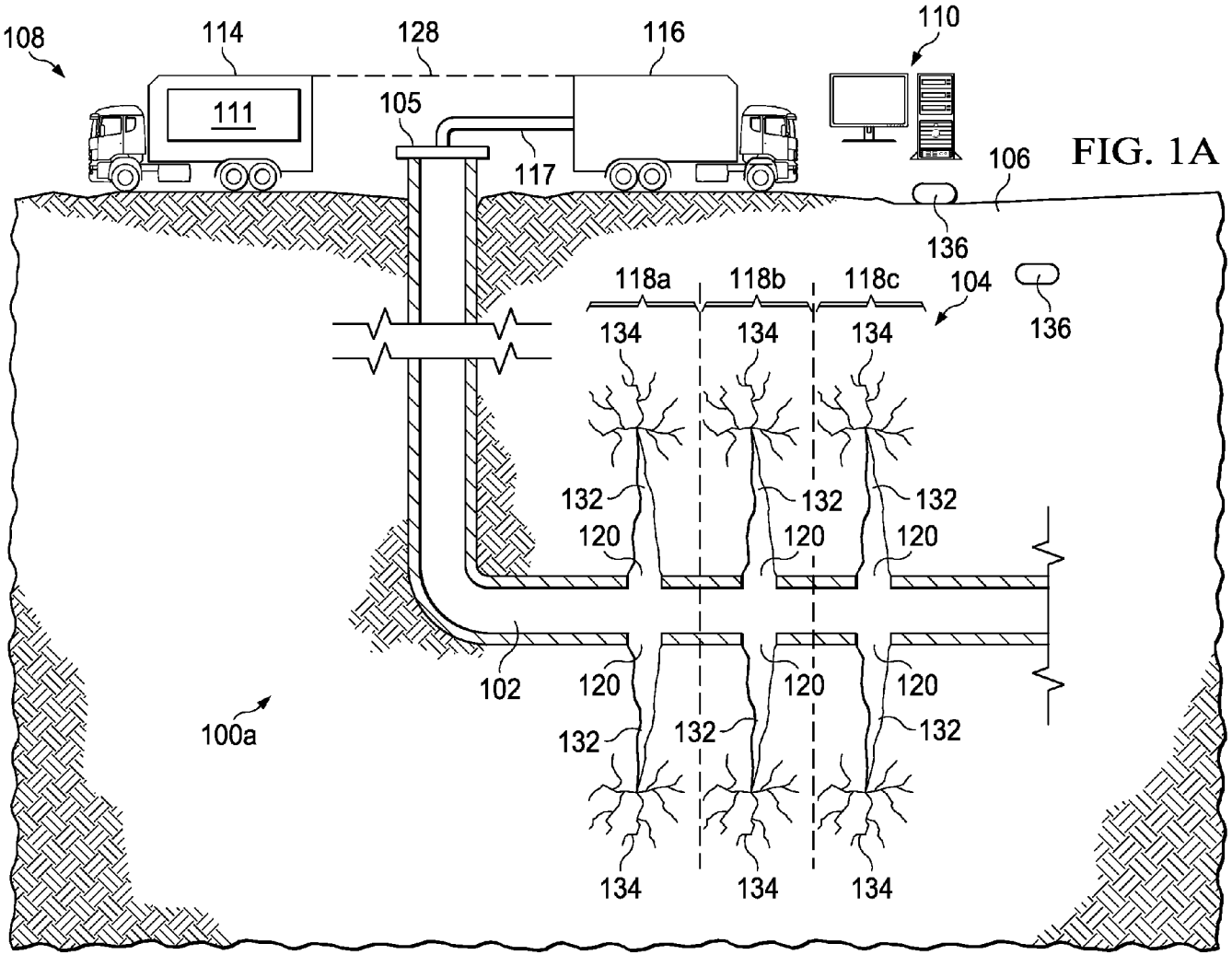
FIG. 1A is a schematic diagram of an example well system.

Some aspects of what is described here relate to injection tests that can be performed, for example, before, during or after an injection treatment of a subterranean region. Data from the injection test can provide information about the subterranean region, and the information can be used, for example, to modify or otherwise design an ongoing or future injection treatment. In some implementations, an injection test includes a time-series of fluid injection periods and shut-in intervals. Each injection period can be followed by a respective shut-in interval, such that the shut-in intervals are interleaved between sequential fluid injection periods. In some instances, an injection test can be referred to as a "stride test," where a single "stride" includes one injection period and one shut-in interval. A stride can include other types of operations, periods, or intervals. In some instances, the stride test includes two or more strides. In some examples, injection rates or injection materials (or both) can vary across the series of injection periods or within a single injection period of a stride test. Stride test data can be used to analyze a subterranean region that will be (or has been) treated. Alternatively or additionally, analysis of the stride test data can be used to design or control an ongoing injection treatment, for example, in real time during the injection treatment.

In some implementations, an injection treatment can be designed based on the information measured, derived, or otherwise analyzed from the stride test. For instance, a pumping stage sequence can be designed to achieve desired fracture properties (e.g., fracture extension, complexity, orientation, spacing, stimulated reservoir volume, connected surface area, etc.). As a specific example, a fracture extension pressure and rate can be obtained from analyzing the stride test data. By manipulating the injection rate of the injection treatment to be below or above the fracture extension rate, the pumping stage sequence can be designed to generate primarily either fracture complexity or fracture length extension, respectively, to create desirable fracture geometry and ultimately improve production, or to achieve other results. Additional or different aspects of an injection treatment (e.g., an injection material, an injection schedule, etc.) can be designed. In some implementations, the injection treatment can be modified or otherwise designed in real time during the treatment based on the information from the injection test.

Some aspects of what is described here can be used, for example, for testing, analyzing, treating, or producing unconventional reservoirs or other types of subterranean regions. In some aspects, the example injection tests described here can help accurately estimate and remove friction from the pressure response at the injection rates tested by the injection test. The pressure response can be observed and analyzed multiple times. Each additional stride in the series can generate new information or confirm previous information. In some instances, the techniques described here can be used to obtain accurate formation properties (e.g., fracture extension pressure and rate, fracture dilation pressure and rate, Instantaneous Shut-In Pressure (ISIP), or other information). The formation properties and other information can be used to optimize or otherwise improve the injection treatment design. In some implementations, the techniques described here can be used to quickly modify or design an injection treatment prior to the treatment or during the treatment in real time on location. In some implementations, engineering expertise, software, and pumping services can be combined to maximize or otherwise improve resource production from the subterranean region, while reducing time or material requirements on location. The stride test and other techniques described here can achieve additional or different advantages in some applications.

Figure 1B:
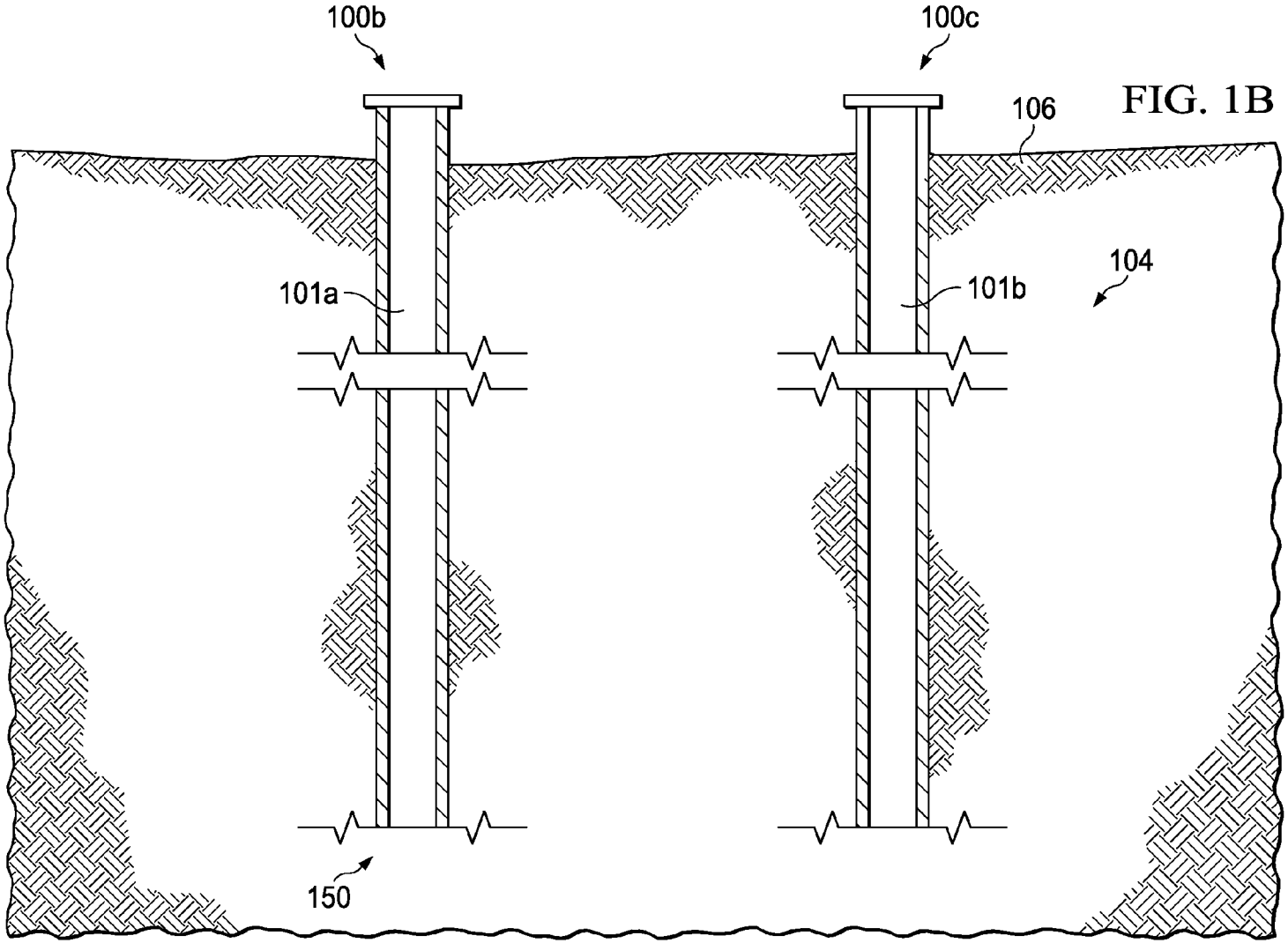
FIG. 1B is a schematic diagram of another example well system.

FIG. 1A is a diagram of an example well system 100*a* and a computing subsystem 110. The example well system 100*a* includes a wellbore 102 in a subterranean region 104 beneath the ground surface 106. The example wellbore 102 shown in FIG. 1A includes a horizontal wellbore. However, a well system may include any combination of horizontal, vertical, slant, curved, or other wellbore orientations. The well system 100*a* can include one or more additional treatment wells, observation wells, or other types of wells. Aspects of an example of a multiple-wellbore system is shown in FIG. 1B.

The computing subsystem 110 can include one or more computing devices or systems located at the wellbore 102, or in other locations. The computing subsystem 110 or any of its components can be located apart from the other components shown in FIG. 1A. For example, the computing subsystem 110 can be located at a data processing center, a computing facility, or another location. The well system 100*a* can include additional or different features, and the features of the well system can be arranged as shown in FIG. 1A or in another configuration.

The example subterranean region 104 may include a reservoir that contains hydrocarbon resources, such as oil, natural gas, or others. For example, the subterranean region 104 may include all or part of a rock formation (e.g., shale, coal, sandstone, granite, or others) that contain natural gas. The subterranean region 104 may include naturally fractured rock or natural rock formations that are not fractured to any significant degree. The subterranean region 104 may include tight gas formations of low permeability rock (e.g., shale, coal, or others).

The example well system 100*a* shown in FIG. 1A includes an injection system 108. The example injection system 108 includes instrument trucks 114, pump trucks 116, and an injection control subsystem 111. The example injection system 108 may include additional or different features. In some aspects of operation, the injection system 108 injects fluid into the subterranean region 104 through the wellbore 102.

The injection system 108 can be used to perform an injection test, whereby fluid is injected into the subterranean region 104 through the wellbore 102. The injection test can be used to obtain information about the subterranean region 104, the wellbore 102, or other aspects of the well system 100*a*. For example, a measurement system can acquire pressure data from the wellbore 102 during the injection test, and the pressure data can be analyzed to determine material, structural, or fluid properties of the subterranean region 104 about the wellbore 102.

In some implementations, an injection test includes a controlled injection sequence that is calibrated to induce a measureable response from the subterranean region 104. In some instances, the injection system 108 may apply the injection tests described with respect to FIGS. 3, 4, 5, and 6. The injection system 108 may apply additional or different injection tests such as, for example, a mini-fracture test, a step-rate test, an in-situ stress test, a pump-in or flowback test, a Diagnostic Fracture Injection Test (DFIT), or other tests.

In some cases, the injection test can be calibrated to induce a pressure response from the subterranean region 104 that can be measured, for example, by pressure sensors in the wellbore 102, and analyzed to gain information about the subterranean region 104. The pressure response (or other response data) obtained from the injection test can be analyzed, for example, by correlating the response data with the controlled parameters (e.g., injection rates, injection materials, etc.) of the injection test. In some cases, a pressure event (e.g., an inflection point or other change in a pressure curve) can be temporally correlated with an injection rate; in turn, physical phenomena associated with the pressure event (e.g., fracture extension) can be associated with the injection rate.

The injection system 108 can be used to perform an injection treatment, whereby fluid is injected into the subterranean region 104 through the wellbore 102. The injection treatment can be used to modify or change the subterranean region 104, for example, to improve stability, conductivity, effective permeability, or other properties of the rock material. In some instances, the injection treatment fractures part of a rock formation or other materials in the subterranean region 104. In such examples, fracturing the rock may increase the surface area of the formation, which may increase the rate at which the formation conducts fluid resources to the wellbore 102.

The injection system 108 may apply injection treatments that include, for example, a single-stage injection treatment, a multi-stage injection treatment, a follow-on fracture treatment, a re-fracture treatment, a final fracture treatment, other types of fracture treatments, or a combination of these. The injection system 108 may also apply an injection test before, during or after an injection treatment. A fracture treatment can be applied at a single fluid injection location or at multiple fluid injection locations in a subterranean region, and the fluid may be injected over a single time period or over multiple different time periods. In some instances, a fracture treatment can use multiple different fluid injection locations in a single wellbore, multiple fluid injection locations in multiple different wellbores, or any suitable combination. Moreover, the fracture treatment can inject fluid through any suitable type of wellbore, such as, for example, vertical wellbores, slant wellbores, horizontal wellbores, curved wellbores, or any suitable combination of these and others.

The example injection system 108 in FIG. 1A uses multiple treatment stages or intervals 118*a*, 118*b*, and 118*c* (collectively "stages 118"). The injection system 108 may delineate fewer stages or multiple additional stages beyond the three example stages 118 shown in FIG. 1A. The stages 118 may each include one or more perforations 120 in the wall of the wellbore 102 or wellbore casing. Fractures in the subterranean region 104 can be initiated at or near the perforation clusters 120 or elsewhere. The stages 118 may have different widths, or the stages 118 may be uniformly distributed along the wellbore 102. The stages 118 can be distinct, non-overlapping (or overlapping) injection zones along the wellbore 102. In some instances, each of the multiple treatment stages 118 can be isolated, for example, by packers or other types of seals in the wellbore 102. In some instances, each of the stages 118 can be treated individually, for example, in series along the extent of the wellbore 102. The injection system 108 can perform identical, similar, or different injection treatments or injection tests (or both) at different stages.

In some implementations, an injection test and an injection treatment can be performed at the same stage or different stages of the multi-stage injection treatment at the same or different time. As an example, the injection test and the injection treatment can be applied at one of the stages 118*a*, 118*b*, and 118*c* sequentially or simultaneously. As another example, an injection test can be applied at a first stage (e.g., stage 118*b* or 118*c*) while the injection treatment is performed at a second stage (e.g., stage 118*a*). The injection test and the injection treatment can be performed in another manner. In some instances, the wellbore 102 is only used for injection treatments, and the injection testing can be performed at another wellbore. In some instances, the wellbore 102 is only used for injection testing, and the injection treatment can be performed at another wellbore.

The pump trucks 116 can include mobile vehicles, immobile installations, skids, hoses, tubes, fluid tanks, fluid reservoirs, pumps, valves, mixers, or other types of structures and equipment. The example pump trucks 116 shown in FIG. 1A can supply fluid or other materials for the injection treatment. The pump trucks 116 may contain multiple different treatment fluids, proppant materials, or other materials for different periods of an injection test, different stages of an injection treatment, etc.

The example pump trucks 116 can communicate fluids into the wellbore 102, for example, through a conduit at or near the level of the ground surface 106. The fluids can be communicated through the wellbore 102 from the ground surface 106 level by a conduit installed in the wellbore 102. The conduit may include casing cemented to the wall of the wellbore 102. In some implementations, all or a portion of the wellbore 102 may be left open, without casing. The conduit may include a working string, coiled tubing, sectioned pipe, or other types of conduit.

The instrument trucks 114 can include mobile vehicles, immobile installations, or other suitable structures. The example instrument trucks 114 shown in FIG. 1A include an injection control subsystem 111 that controls or monitors the fluid injection applied by the injection system 108. The communication links 128 may allow the instrument trucks 114 to communicate with the pump trucks 116, or other equipment at the ground surface 106. Additional communication links may allow the instrument trucks 114 to communicate with sensors or data collection apparatus in the well system 100*a*, remote systems, other well systems, equipment installed in the wellbore 102 or other devices and equipment.

The injection system 108 may also include surface and down-hole sensors 136 to measure pressure, rate, fluid density, temperature or other parameters of treatment or production. For example, the injection system 108 may include pressure meters or other equipment that measure the pressure in the wellbore 102 at or near the ground surface 106 level or at other locations. The injection system 108 may include pump controls or other types of controls for starting, stopping, increasing, decreasing or otherwise controlling pumping as well as controls for selecting or otherwise controlling fluids pumped during the injection treatment. The injection control subsystem 111 may communicate with such equipment to monitor and control the injection treatment.

The injection system 108 may inject fluid into the subterranean region 104 above, at, or below a fracture initiation pressure, a fracture closure pressure, a fracture extension pressure, or at another fluid pressure. Fracture initiation pressure may refer to a minimum fluid injection pressure that can initiate fractures in the subterranean formation. Fracture closure pressure may refer to a minimum fluid injection pressure that can dilate existing fractures in the subterranean formation. Fracture extension pressure may refer to a minimum fluid injection pressure that can cause the fracture to extend or propagate in the subterranean formation.

Similarly, the injection system 108 may inject fluid into the subterranean region 104 above, at, or below a fracture initiation rate, a fracture closure rate, a fracture extension rate, or at another fluid injection rate. For example, fracture initiation pressure, a fracture closure pressure, a fracture extension pressure may each be associated with a respective fluid injection rate. The fluid injection rate can be the flow rate of an injected fluid at a measured or metered location in the injection system 108. For example, the fluid injection rate may describe a flow rate at the well head 105, in the pump truck 116, within the wellbore 102, or at a combination of these and other locations in the well system 100*a*.

The example injection control subsystem 111 shown in FIG. 1A can control operation of the injection system 108. The injection control subsystem 111 may include data processing equipment, communication equipment, monitoring equipment or other systems that control injection tests or treatments applied to the subterranean region 104 through the wellbore 102. The injection control subsystem 111 may be communicably linked to the computing subsystem 110 that can calculate, select, or optimize injection treatment parameters, for example, for initialization, extending, or dilating fractures in the subterranean region 104. The injection control subsystem 111 may receive, generate, or modify an injection test design or an injection treatment design (e.g., an injection test sequence, a pumping stage sequence, etc.) that specifies parameters (e.g., injection rate and material) of an injection test or an injection treatment to be applied to the subterranean region 104.

In some instances, the injection control subsystem 111 may interface with controls of the injection system. For example, the injection control subsystem 111 may initiate control signals that configure the injection system 108 or other equipment (e.g., pump trucks, etc.) to execute aspects of an injection test or treatment. The injection control subsystem 111 may receive data collected from the subterranean region 104 or another subterranean region by sensing equipment, and the injection control subsystem 111 may process the data or otherwise use the data to select or modify parameters of an injection test or treatment to be applied to the subterranean region 104. The injection control subsystem 111 may initiate control signals that configure or reconfigure the injection system 108 or other equipment based on selected or modified properties.

In some implementations, the injection control subsystem 111 controls the injection treatment in real time based on measurements obtained from the injection treatment, an injection test, or other information during the injection treatment. For example, pressure meters, flow monitors, microseismic equipment, fiber optic cables, temperature sensors, acoustic sensors, tiltmeters, or other equipment can monitor the injection test or treatment. In some implementations, observed surface pressure, bottomhole pressure, or another pressure measured during an injection test can be used to determine when and in what manner to modify, or otherwise control the treatment parameters to achieve desired fracture properties. For example, the injection control subsystem 111 may switch, modify, or otherwise control injection rate and material of an injection treatment to maximize or otherwise improve fracture volume or connected fracture surface area. Controlling the injection treatment may include controlling pumping pressures, pumping rates, pumping volumes; selecting or modifying fluid properties (for example, by adding or removing gelling agents to adjust viscosity), proppant concentrations; using diversion techniques; using stress interference techniques; optimizing spacing between perforations; or any other appropriate methods to control the injection treatment to achieve desirable fracture extension and complexity.

In the example shown in FIG. 1A, the injection system 108 has fractured the subterranean region 104. The fractures 132 may include fractures of any length, shape, geometry or aperture that extend from perforations 120 along the wellbore 102 in any direction or orientation. The fractures 132 may be formed by hydraulic injections at multiple stages or intervals, at different times or simultaneously. The fractures 132 may extend through regions that include natural fracture networks 134, regions of un-fractured rock, or both. In the example shown, the dominant fractures 132 intersect the natural fracture networks 134.

An injection test can be performed before the subterranean region 104 is fractured. For example an injection test can communicate fluid into the subterranean region 104 through one or more of the perforations 120, or at other locations, before the hydraulic fractures 132 have formed, or before the natural fractures have been modified by an injection treatment. In some cases, the subterranean region 104 is substantially unfractured when the injection test is initiated. An injection test may, in some instances, create or extend fractures in the subterranean region 104. For example, an injection test may initiate hydraulic factures at or near the perforations 120, or an injection test may extend or modify existing fractures in the subterranean region 104.

An injection test can be performed after the subterranean region 104 is fractured. For example an injection test can communicate fluid into the subterranean region 104 through one or more of the perforations 120, or at other locations, after the hydraulic fractures 132 have been formed by a fracture treatment. In some cases, the subterranean region 104 contains fractures (e.g., natural fractures, artificial fractures, or both) when the injection test is initiated. An injection test may, in some instances, create additional fractures or extend existing fractures in the subterranean region 104.

In some subterranean environments, fractures formed by a hydraulic injection tend to form along or approximately along a preferred fracture direction, which is typically related to the stress in the formation. In the example shown, the preferred fracture direction is perpendicular to the wellbore 102. In some instances, changing the injection rate or pressure (e.g., above a critical or threshold pressure) can change the growth of hydraulic fractures. For example, the dominant fractures can extend in length to the reservoir if the injection rate is beyond a fracture extension rate. The fractures can dilate or reorient (e.g., grow along directions that are not perpendicular to the wellbore 102) if the injection rate is below the fracture extension rate and above a fracture dilation rate. In some instances, the fracture dilation can be achieved by using appropriate injection materials (e.g., use of reactive fluids, use of very small, micron-sized proppant materials, or other appropriate treatments). The conductivity or effective permeability of the dilated fractures can be increased. These dilated, leak off induced fractures may then provide a path to the dominant hydraulic fracture to increase the exposed surface area, create more complexity of the fracture network, and enhance the ability of hydrocarbon to flow through the created fracture system and into the wellbore.

In some aspects of operation, the injection system 108 can perform an injection test before or during an injection treatment, for example, under the control of the injection control system 111. The injection test can include multiple injection periods and shut-in intervals. The injection test can employ various injection rates and injection materials to test and measure the response of the subterranean region 104 to the varied materials. Sensors (e.g., the sensors 136) or other detecting equipment in the well system 100*a* can detect and monitor the subterranean response (e.g., pressure, temperature, etc.), collect and transmit the response data, for example, to the computing subsystem 110. The computing subsystem 110 can receive and analyze the response data, and design an injection treatment based on the response data. In some instances, the computing subsystem 110 may identify a fracture extension pressure based on the response data from the injection test and design an injection rate of an injection treatment based on the fracture extension pressure to create more or less fracture extension or complexity. The injection system 108 can receive the injection treatment design and apply the injection treatment to the subterranean region 104. In some instances, the subterranean region's response to the injection treatment can be monitored and measured, and the collected response data to the injection treatment can in turn be used to modify the injection test and the injection treatment, for example, in real time during the injection treatment.

FIG. 1B is a diagram of another example well system 150. The example well system 150 includes two well subsystems 100*b* and 100*c* and the subsystems each include wellbores 101*a* and 101*b*, respectively, in the subterranean region 104 beneath the ground surface 106. The well subsystems 100*b* and 100*c* can each have the same configuration as the well system 100*a* as shown in FIG. 1A. For instance, the well subsystems can include computing subsystems, injection subsystems, injection control subsystems, and other features as shown in FIG. 1A. In some instances, one or both of the well subsystems 100*b* and 100*c* can be configured in another manner. The illustrated wellbores 101*a* and 101*b* include vertical wellbores. However, a well subsystem may include any combination of horizontal, vertical, slant, curved, or other wellbore orientations. The well system 150 can include one or more additional treatment wells, observation wells, or other types of wells. The well system 150 can include additional or different well subsystems.

In some instances, the well subsystem 100*b* may operate substantially independent of the well subsystem 1 OOc, or the well subsystem 100*b* may interact with the well subsystem 100*c*. For example, the well subsystems 100*b* and 100*c* can each operate in response to information provided by the other. In some cases, an injection test and an injection treatment can be performed in the same wellbore 101*a* or 101*b*, sequentially or concurrently. In some cases, an injection test is performed at the wellbore 101*a* and an injection treatment is performed at the wellbore 101*b*. The injection treatment at the wellbore 101*b* can be designed or modified based on information obtained from the injection test at the wellbore 101*a*. The injection test and treatment can be performed in another manner.

Some of the techniques and operations described herein may be implemented by one or more computing systems configured to provide the functionality described. In various embodiments, a computing system may include any of various types of devices, including, but not limited to, personal computer systems, desktop computers, laptops, notebooks, mainframe computer systems, computer clusters, distributed computing systems, handheld computers, workstations, tablets, application servers, storage devices, or any type of computing or electronic device.

Figure 2:
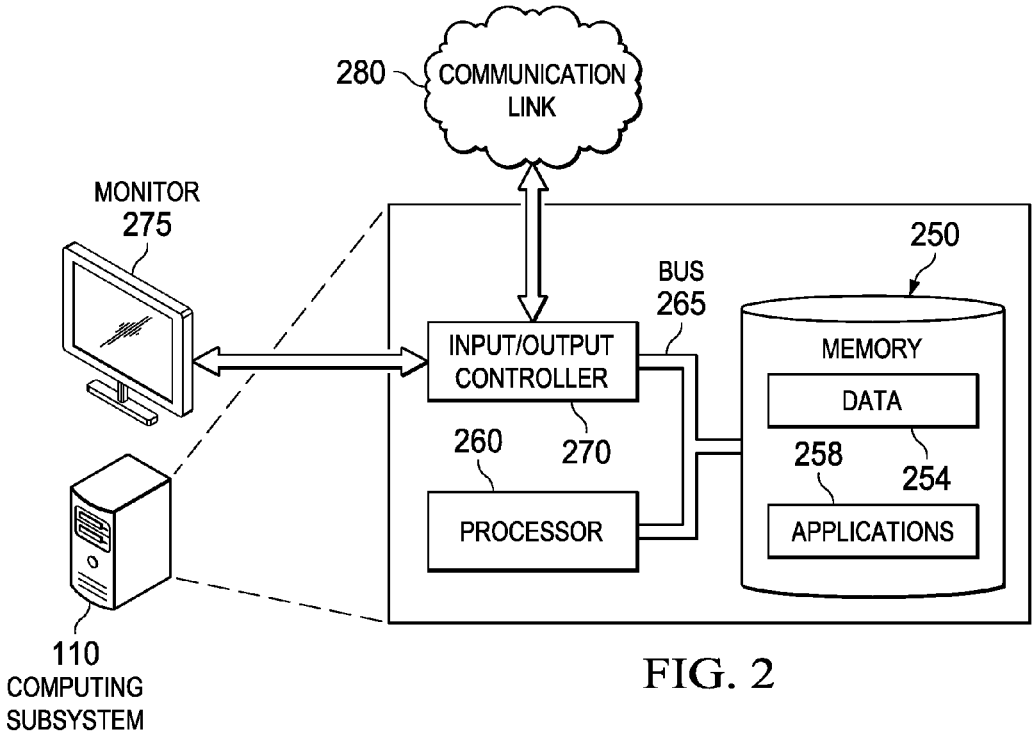
FIG. 2 is a diagram of the example computing subsystem 110 of FIG. 1A.

FIG. 2 is a diagram of the example computing subsystem 110 of FIG. 1A. The example computing subsystem 110 can be located at or near one or more wells of the well system 100*a* or at a remote location. All or part of the computing subsystem 110 may operate independent of the well system 100*a* or independent of any of the other components shown in FIG. 1A. The example computing subsystem 110 includes a memory 250, a processor 260, and input/output controllers 270 communicably coupled by a bus 265. The memory can include, for example, a random access memory (RAM), a storage device (e.g., a writable read-only memory (ROM) or others), a hard disk, or another type of storage medium. The computing subsystem 110 can be preprogrammed or it can be programmed (and reprogrammed) by loading a program from another source (e.g., from a CD-ROM, from another computer device through a data network, or in another manner). In some examples, the input/output controller 270 is coupled to input/output devices (e.g., a monitor 275, a mouse, a keyboard, or other input/output devices) and to a communication link 280. The input/output devices receive and transmit data in analog or digital form over communication links such as a serial link, a wireless link (e.g., infrared, radio frequency, or others), a parallel link, or another type of link.

The communication link 280 can include any type of communication channel, connector, data communication network, or other link. For example, the communication link 280 can include a wireless or a wired network, a Local Area Network (LAN), a Wide Area Network (WAN), a private network, a public network (such as the Internet), a WiFi network, a network that includes a satellite link, or another type of data communication network.

The memory 250 can store instructions (e.g., computer code) associated with an operating system, computer applications, and other resources. The memory 250 can also store application data and data objects that can be interpreted by one or more applications or virtual machines running on the computing subsystem 110. As shown in FIG. 2, the example memory 250 includes data 254 and applications 258. The data 254 can include treatment data, testing data, geological data, fracture data, microseismic data, or any other appropriate data. The applications 258 can include a fracture design model, a reservoir simulation tool, a fracture simulation model, or any other appropriate applications. In some implementations, a memory of a computing device includes additional or different data, application, models, or other information.

In some instances, the data 254 include treatment data relating to fracture treatment plans. For example the treatment data can indicate a pumping schedule, parameters of a previous injection treatment, parameters of a future injection treatment, or parameters of a proposed injection treatment. Such parameters may include information on flow rates, flow volumes, slurry concentrations, fluid compositions, injection locations, injection times, or other parameters. The treatment data can include treatment parameters that have been optimized or selected based on numerical simulations of complex fracture propagation.

In some instances, the data 254 include injection test data relating to an injection test. For example, the injection test data can injection rates, injection materials, durations of injection periods and shut-in intervals, or a combination of these and other parameters of an injection test. As another example, the injection test data can include pressure data, flow data, seismic data, or a combination of these and other types of response data acquired during an injection test. The data 254 may also include additional information obtained from analyzing the injection test data. For example, the data 254 may include formation properties determined from the injection test, such as, for example, the natural or hydraulic fracture extension pressure, fracture extension rate, natural or hydraulic fracture dilation pressure, fracture closure pressure, fracture re-open pressure, and various other information In some instances, the data 254 include geological data relating to geological properties of the subterranean region 104. For example, the geological data may include information on the wellbore 102, completions, or information on other attributes of the subterranean region 104. In some cases, the geological data includes information on the lithology, fluid content, stress profile (e.g., stress anisotropy, maximum and minimum horizontal stresses), pressure profile, spatial extent, or other attributes of one or more rock formations in the subterranean zone. The geological data can include information collected from well logs, rock samples, outcroppings, microseismic imaging, or other data sources.

In some instances, the data 254 include fracture data relating to fractures in the subterranean region 104. The fracture data may identify the locations, sizes, shapes, and other properties of fractures in a model of a subterranean zone. The fracture data can include information on natural fractures, hydraulically-induced fractures, or any other type of discontinuity in the subterranean region 104.

The applications 258 can include software applications, scripts, programs, functions, executables, or other modules that are interpreted or executed by the processor 260. For example, the applications 258 can include an injection test design tool, an injection test analysis tool, an injection treatment design tool, a fracture design module, a reservoir simulation tool, a hydraulic fracture simulation model, or any other appropriate applications. The applications 258 may include machine-readable instructions for performing one or more of the operations related to FIGS. 3-6. The applications 258 may include machine-readable instructions for generating a user interface or a plot, for example, illustrating wellbore pressure, injection rates, or other information. The applications 258 can obtain input data, such as treatment data, geological data, injection test data, or other types of input data, from the memory 250, from another local source, or from one or more remote sources (e.g., via the communication link 280). The applications 258 can generate output data and store the output data in the memory 250, in another local medium, or in one or more remote devices (e.g., by sending the output data via the communication link 280).

The processor 260 can execute instructions, for example, to generate output data based on data inputs. For example, the processor 260 can run the applications 258 by executing or interpreting the software, scripts, programs, functions, executables, or other modules contained in the applications 258. The processor 260 may perform one or more of the operations related to FIGS. 3-6. The input data received by the processor 260 or the output data generated by the processor 260 can include any of the treatment data, the geological data, the fracture data, or any other data 254.

Figure 3:
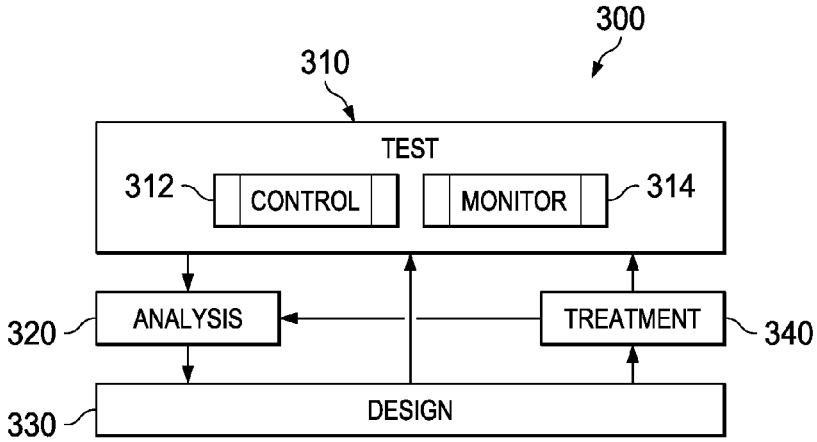
FIG. 3 is a schematic diagram of an example system architecture.

FIG. 3 is a schematic diagram of an example system architecture 300. In some instances, the example system architecture 300 can be used to design, control, and perform injection tests and injection treatments for a subterranean region. The example system architecture 300 includes a test system 310, an analysis system 320, a design system 330, and a treatment system 340. Testing and treatment systems can include additional or different features. In some cases, aspects of the example system architecture 300 can be implemented in a well system associated with a subterranean region, such as the example well systems 100*a* and 150 shown in FIGS. 1A and 1B or another type of well system. In some cases, the example system architecture 300 can be used to implement some or all of the operations shown in FIG. 6 or the system architecture 300 can be used in another manner.

In some implementations, various aspects of the system architecture 300 can interact with each other or operate as mutually-dependent subsystems. In some other implementations, some aspects of the system architecture 300 can be implemented as separate systems and operate substantially independently of one other. Generally, one or more of the systems 310-340 can operate sequentially or concurrently. In some instances, one or more of the systems 310-340 can operate concurrently and execute operations (e.g., in real time) in response to information provided by the other.

In some implementations, the test system 310 can be implemented, for example, in an injection system with an injection control system (e.g., the injection system 108 shown in FIG. 1A), or another type of system. The test system can include, for example, a control subsystem 312, a monitor subsystem 314, or other subsystems.

The control subsystem 312 can include, for example, a computing system, wellbore completion equipment, pumping equipment, measurement tools, or other types of systems that provide control of an injection test. The control subsystem 312 can be implemented by pump trucks, control trucks, computing systems, working strings, conduits, communication links, measurement systems, or by combinations of these and other types of equipment in a well system. The control subsystem 312 may interact with additional or different subsystems or systems to control an injection test. For example, the control subsystem 312 can control one or more of an injection rate, an injection material, an injection duration, or other parameters or operations associated with an injection test. As an example, the control subsystem 312 may obtain an injection test design from the design system 330 and control the injection test to execute the designed test. In some implementations, the control subsystem 312 may receive modifications or redesigns of an injection test from the design system 330. The control subsystem 312 can then generate control signals to adjust the injection test accordingly. As another example, the control subsystem 312 can interact with the monitoring subsystem 314 to control the injection test based on the formation response obtained from the monitoring subsystem 314, for example, in real time during the injection test.

The monitor subsystem 314 can include, for example, monitoring equipment capable of receiving or measuring injection rates, pressure (e.g., one or more of a surface pressure, a bottom hole pressure, etc.), and other information for a subterranean region. In some instances, the monitor subsystem 314 can include sensors, detecting equipment, or other software and hardware that can detect, collect, extract, record, or otherwise monitor the subterranean region. In some instances, the monitor subsystem 314 can be located remote from the well system. For example, the monitor subsystem 314 can be a computing system that receives data acquired on site at the well system, for example, by measurement equipment installed in a wellbore. In some implementations, the monitor subsystem 314 can acquire response data of the subterranean region from an injection test, an injection treatment, or both. The monitor subsystem 314 can store or transmit the response data, for example, to the control subsystem 312, the analysis system 320, or another system.

The analysis system 320 and the design system 330 can be implemented, for example, in a computing system, which may include one or more data processing apparatus, a design interface or other user-interface tools, various models, and other types of components. In some cases, the analysis and design systems 320, 330 can be implemented on a computing system such as the example computing subsystem 110 shown in FIG. 2. The analysis and design systems 320, 330 can be implemented as separated systems or as an integrated system. The analysis and design systems 320, 330 can include various tools (e.g., injection test or treatment design tools), models (e.g., fracture models, reservoir models, leak off models, wellbore models, etc.), simulation tools, or other modules for analyzing the subterranean data and designing injection tests and treatments.

In some implementations, the analysis system 320 can receive subterranean data, for example, from the monitoring system 314, or another source. The subterranean data can include pressure, temperature, microseismic, or any other type of data of a subterranean region in response to an injection test (e.g., a test performed by the test system 310), an injection treatment (e.g., a treatment performed by the treatment system 340), or both. The analysis system 320 can analyze the response data and calculate, derive, or otherwise obtain formation properties such as the natural or hydraulic fracture extension pressure, fracture extension rate, natural or fracture dilation pressure, fracture close pressure, fracture re-open pressure, and various other information. The analysis system 320 can analyze the response data based on the example techniques described with respect to FIG. 4, or the analysis system 320 can be operable to perform additional or different analyses. The analysis system 320 can output the analysis results to the design system 330 for modifying or otherwise designing an injection test or treatment.

The design system 330 can generate, modify, or otherwise design an injection test or an injection treatment (or both) based on, for example, formation properties, user inputs, or other information. The formation properties can include the properties obtained by the analysis system 320, properties of a similar subterranean region or an adjacent wellbore, or other information. As an example, the design system 330 can receive a fracture extension rate of the subterranean region from the analysis system 320 and may design an injection treatment based on the fracture extension rate. For instance, the design system 330 can design a pumping sequence with an injection rate alternating between a rate being above and another rate being below the fracture extension rate. In some instances, the design system 330 can allow a user (e.g., a well operator, a design engineer, an analyst, etc.) to specify, for example, one or more desired fracture network properties (e.g., lateral extension, orientation, size, spacing, stimulated reservoir volume, connected surface area, etc.), treatment parameters (the number and locations of perforations, the number of treatment stages, injection materials, etc.), or other information. In some examples, given the injection materials, rates, pressure response, and some minimal reservoir properties, the design system 330 may automatically generate a treatment pumping schedule. In some other instances, the design system 330 can automatically calculate, derive, or otherwise design, for example, an injection material, injection rate, injection duration, or other injection parameters (e.g., where and when to inject, the number of injection stages, etc.) for an injection test or an injection treatment.

In some instances, an injection test can include a series of shut-in intervals in addition to injection periods. The design system 330 can design the durations for each shut-in interval and injection period for the injection test. In some implementations, the design system 330 can allow a design engineer to select an injection material for an injection test, specify a starting rate of an injection test, modify a designed parameter for an injection test or treatment, or otherwise control or manage an injection test or treatment design. In some implementations, the design system 330 can design an injection test or treatment based on the example techniques described with respect to FIGS. 4 and 5, or the design system 330 can perform additional or different operations to design an injection test or treatment. The designed injection test and treatment can be sent to the test system 310 and the treatment system 340 for execution, respectively.

The treatment system 340 can be implemented, for example, in an injection system such as the injection system 108 shown in FIG. 1A. In some implementations, the treatment system 340 can include multiple subsystems, for example, a control subsystem, a monitor subsystem, or other subsystems. The control subsystem and monitor subsystem can be similar to the control subsystem 312 and the monitoring monitor subsystem 314 of the test system 310, or they can be different. The treatment system 340 can include an injection control subsystem such as the injection control subsystem 111 shown in FIG. 1A to control an injection treatment. In some implementations, some or all aspects of the treatment system 340 and the test system 310 can share the hardware, software, or a combination of both, or they can be implemented as separated platforms.

In some implementations, the treatment system 340 can receive an injection treatment design from the design system 330 and perform an injection treatment according to the design. For example, the injection treatment design can include a pumping sequence design (e.g., with specified pumping pressures, pumping rates, pumping volumes, fluid properties, proppant concentration, diverter type, etc.), a treatment plan (e.g., where to inject, how many fracturing stages, etc.), or other properties of an injection treatment. In some implementations, the injection treatment can be monitored and treatment data (e.g., the subterranean data in response to the treatment) can be passed to the analysis system 320 for processing. In some instances, the analysis of the treatment data can trigger the design system 330 to modify or otherwise design the injection treatment. In some instances, the injection treatment can be modified, adjusted, or otherwise controlled automatically by an injection control system, manually by a well operator or field engineer, or in a hybrid manner during the treatment. In some instances, the analysis of the treatment data may trigger a modification or a design of an injection test.

The example system architecture 300 can help create and execute an engineering workflow for injection tests and injection treatments. As an example engineering workflow, the test system 310 can execute an injection test that may be, for example, initially generated by the design system 330. The analysis system 320 can receive and analyze the response data from the injection test. Based on the analysis result, the design system 330 can design an injection treatment. The treatment system 340 can receive the design and execute the designed injection treatment. In some instances, the response data of the injection treatment can be fed back to the analysis system 320. The analysis system 320 can analyze, for example, data and measurements, and interact with the design system 340, for example, to refine the injection treatment design, generate a new injection test, or perform additional or different operations. Additional or different types of workflows can be performed using the systems 310-340.

In some implementations, one or more of the systems 310-340 can be automated systems and the workflow can be an automated process. For instance, the one or more of the systems 310-340 may include computer-implemented algorithms that can automatically execute the engineering workflow. In some instances, an injection test can be performed before or during a main treatment, the automated design or modification of a treatment can help minimize or otherwise reduce the amount of time spent on, for example, injection, shut-in, switching between fracture dilation and fracture extension, or others. As an example, in some cases, a manual analysis process might take substantially more time than an automated process. The automation of the workflow can help a quick analysis of the subterranean region and a timely design of the injection treatment. The up-to-date injection treatment design can better fit the current subterranean region and improve or maximize the hydrocarbon production from the subterranean region. In some implementations, the one or more of the systems 310-340 can be controlled or managed by one or more operations engineer, for example, through a user interface or control. The example workflow can, in some instances, combine engineering expertise, software, pumping services, and other features on- or off-location for providing sophisticated and thorough subterranean region analysis and injection test and treatment design. Execution of the workflow can help maximize or otherwise improve productivity of both conventional and unconventional reservoirs, without substantial time or material requirements.

Figure 4:
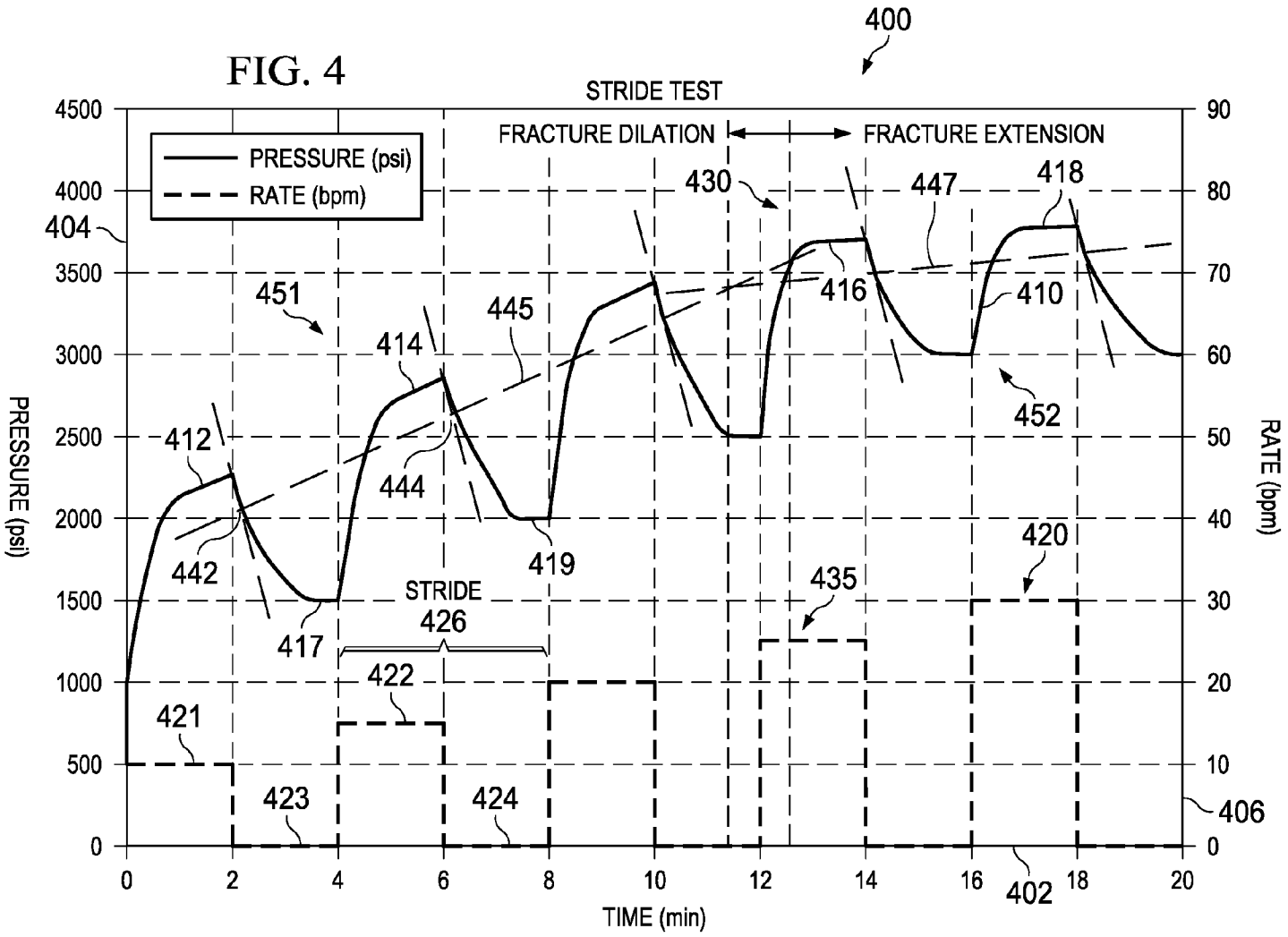
FIG. 4 is a plot showing an injection rate and a pressure response of an example injection test.

FIG. 4 is a plot 400 illustrating an injection rate 420 and a pressure response 410 of an example injection test. The injection rate 420 (in barrel per minute (bpm)) and the pressure response 410 (in pounds per square inch (psi)) are plotted versus time 402 (in minutes). The pressure 410 can be, for example, a surface pressure, a bottomhole pressure, or another pressure measured in or near the subterranean region. In some cases, the pressure response 410 can include the bottomhole pressure; analysis based on bottomhole pressure may, in some instances, lead to more accurate analysis, for example, where a large error range due to friction can be eliminated or reduced by using the bottomhole pressure. The bottomhole pressure can be calculated as the Instantaneous Shut In Pressure (ISIP) minus hydrostatic pressure, for instance.

The example injection test shown in FIG. 4 includes a succession of injection periods (e.g., injection periods 421 and 422) and shut-in intervals (e.g., shut-in intervals 423 and 424). In some instances, the example injection test can be referred to as a stride test where a single "stride" 426 includes the combination of one injection period 422 and one shut-in interval 424. In some instances, following each injection period by a shut-in interval can help remove the effects of wellbore friction in the pressure response data, which can provide more accurate data for analysis.

The example injection test shown in FIG. 4 includes a series of five strides of equal duration; each injection period has the same duration as the subsequent shut-in interval. An injection test can include additional or fewer strides, and each stride, injection period, or shut-in interval can have a distinct duration. For example, the duration of each injection period, the duration of each shut-in interval, or both, can be varied over the injection test. For example, the injection period in each stride can be longer or shorter than the subsequent shut-in interval in the same stride; or the injection period in each stride can be longer or shorter than the injection period in the previous or subsequent stride. Similarly, the shut-in interval in each stride can be longer or shorter than the shut-in interval in the previous or subsequent stride In the example shown in FIG. 4, the injection rate 420 is increased over time across different injection periods and maintained constant within each individual injection period. In particular, the injection rate increases with each successive stride, from below a fracture extension pressure to above the fracture extension pressure, over the course of the injection test. In some cases, the injection rate remains constant or is varied in another manner over the course of the injection test. Moreover, the injection rate can vary (increase or decrease) during an individual injection period.

In some instances, the rate increments of a respective subsequent injection period relative to the prior injection period (e.g., the injection period 422 relative to the injection period 421) can be the same or different across the multiple injection periods. In some implementations, the injection rate of an individual injection period can be maintained until the pressure stabilizes. For example, each injection period may last at least to a point where the pressure curve 410 reaches a steady slope such as the constant slope at 412 and 414. In some cases, an injection period can be, for example, about 30 seconds to 2 minutes, or a longer or shorter duration can be used. During each injection period, one or more of fluids, proppants, and diverters can be used to test and determine the subterranean response to the varied materials.

In the example shown in FIG. 4, the injection rate is zero for the duration of each shut-in interval. In other words, fluid injection is stopped during the example shut-in intervals shown in FIG. 4. The shut-in intervals can be accomplished, for example, by shutting in the wellbore for a specified duration of time; the wellbore can be shut-in for example by sealing ports (inlets, outlets) and flow paths into and out of the wellbore at or near the well head or other locations. The wellbore shut-in can isolate the wellbore from well system components above the ground surface, while allowing fluid communication between the wellbore and the surrounding subterranean region (e.g., through the wellbore wall, perforations, etc.). In some instances, a wellbore shut-in allows fluid conditions in the wellbore to reach a steady state condition with the surrounding subterranean region. A shut-in can be performed in another manner, and may produce other types of results.

In some instances, the shut-in intervals interleaved within the series of strides can help remove or reduce the effects of friction in the pressure measurement associated with each injection rate, and allow the pressure response to be monitored starting from zero injection rate multiple times. Each additional stride can create new information or confirm previous information related to the subterranean region.

In some instances, the shape of the pressure response curve 410 in response to each injection period and shut-in interval contains useful information and can be analyzed to extract, derive or otherwise obtain formation properties of the subterranean region. For example, the pressure curve 410 can be analyzed by fitting a fracture model with a few unknown parameters, or the pressure curve 410 can be broken up into several line segments where the slope and intercept of each segment can be analyzed to obtain respective physical interpretations. For instance, the plot 400 can be divided into two regions: natural fracture dilation region 451 to the left and hydraulic fracture extension region 452 to the right. In some instances, the pressure 410 rises as the injection rate 420 increases. The pressure curve 410 may maintain a consistent slope during fracture dilation and change the slope when fracture extension occurs. In some implementations, the injection rate of the injection test can be increased at least to a point where fracture extension occurs.

In some implementations, the fracture extension can be identified, for example, by monitoring the pressure response and determining the slope change of the pressure curve 410. In the illustrated plot 400, the pressure curve 410 in each stride reaches a constant or substantially constant slope (as indicated, for example, at 412, 414, and 418). In the example shown, the pressure curve 410 reaches the same (or substantially the same) constant slope in all three strides in the natural fracture dilation region 451; similarly, the pressure curve 410 reaches the same (or substantially the same) constant slope in both strides in the hydraulic fracture extension region 452. As shown in FIG. 4, the slope in the natural fracture dilation region 451 is different from the slope in the hydraulic fracture extension region 452. As illustrated, the regions of constant slope in the natural fracture dilation region 451 are relatively steep while the regions of constant slope in the hydraulic fracture extension region 452 are relatively flat. The transition between the two different slopes is indicated at 430 in FIG. 4. The pressure corresponding to the slope transition at 430 can be identified as the fracture extension pressure. The injection rate 435 corresponding to the fracture extension pressure can be identified as the fracture extension rate. In some implementations, the pressure (e.g., bottomhole pressure) can be plotted versus the injection rate and the intersection between two pressure curves can be identified as the fracture extension pressure. In some instances, the fracture extension pressure and rate can be determined in another manner.

Other formation properties can be derived, estimated, or otherwise identified based on the injection test. For example, near wellbore or perforation restrictions can be characterized by using a qualitative indicator indicating the amount of water hammer or no water hammer and analyzing the damping of injection flow and pressure oscillation. A natural fracture response can be determined based on the shape of the pressure response curve when the pressure is less than fracture extension pressure (e.g., the natural fracture dilation region 451 in FIG. 4). Natural fracture dilation pressure can be identified based on the natural fracture response. Accurate friction at each injection rate can be determined based on a difference between pressure at the rate and the ISIP. Fracture re-opening pressure can be derived, for example, based on the early part of the next stride after fracture extension (e.g., around segment 416). In some instances, fracture closure pressure is assumed to be below the fracture extension pressure and the fracture extension pressure can be identified as the closure pressure upper bound.

In some instances, certain formation properties can be identified based on the subterranean response in connection with the shut-in intervals of the injection test. For example, the pressure declines during the shut-in intervals. The shape, the decline rate, or other information of the pressure curve 410 can be analyzed to derive formation properties. As an example, the ISIP can be analyzed based on the pressure curve 410 during one or more shut-in intervals (e.g., the shut-in intervals 423, 424). In some instances, the ISIP for each shut-in interval can be used to analyze other information. For example, the respective inflection points (e.g., the inflection points 442 and 444) of the pressure curve 410 corresponding to the shut-in intervals (e.g., the shut-in intervals 423 and 424) can be identified and selected for analysis. As an example, lines 445 and 447 can be drawn based on the identified inflection points. The slope, shape, intersection, or other attributes of the lines 445 and 447 can be analyzed, for example, in a manner similar to the analysis performed based on the pressure curve 410 corresponding to the injection periods, or the lines 445 and 447 can be analyzed in another manner. In general, any point or portion of the pressure curve 410 of the injection test can be selected, for example, by a user (e.g., a well operator, a design engineer, an analyst, etc.) for analysis. For instance, the relatively flat portion (e.g., portions 417 and 419) of the pressure curve 410 can be used to identify or otherwise analyze the ISIP, leak-off, fracture closure, or any other information of the subterranean region. In some instances, the duration for both the shut-ins and the injections of the injection test can vary and can be minimized depending upon the response of the subterranean region. For instance, in some cases, the shut-ins do not need to be monitored to closure. The shut-in intervals can be designed to be long enough to get a good ISIP estimation and an initial pressure decline rate. In some cases, the shut-in intervals can be, for example, about 30 seconds or another value. In some instances, the water hammer effect or lack thereof at each shut-in interval can give qualitative indications of near wellbore issues. The decline amount, decline rate, or other information of the pressure during each shut-in interval can be used to estimate the friction number.

In some instances, formation properties can be determined in a different manner. In some instances, additional or different formation properties can be determined. In some implementations, one or more other types of diagnostic pumping tests and analysis, for example, a step down test, minifrac test, DFIT test, etc., could be performed in conjunction with the example injection test. Additional or different information and subterranean responses can be identified and analyzed based on these tests.

In some implementations, the multiple injection periods and shut-in intervals (e.g., strides) of the injection test can be used to verify, reinforce, refine, otherwise assess an analysis made out of a single injection period or shut-in interval. A more accurate analysis of the subterranean region can be achieved based on the multiple injection periods and shut-in intervals. As an example, a respective ISIP value can be determined based on each of the multiple shut-in intervals (e.g., the shut-in intervals 423 and 424). The ISIP values identified from the multiple shut-in intervals can be compared, interpolated, or otherwise manipulated to obtain a more accurate ISIP estimation for the entire injection test. In some implementations, an identified formation property can be refined or otherwise modified in real time during the injection test as information of subsequent injections and shut-ins accumulates. For instance, the ISIP estimated based on the shut-in interval 423 can be refined as the estimation based on the shut-in interval 424 arrives.

In some instances, an injection test can be run with a single wellbore fluid. Formation properties related to the single wellbore fluid can be identified at multiple injection rates and can be used for prediction regularly or from time to time. As an example, friction numbers of an injection material (e.g., a linear gel, a cross-linked gel, etc.) at multiple rates can be determined and used to improve friction prediction.

In some instances, based on the formation properties obtained from the injection test, an injection treatment can be designed. An injection treatment can be modified or otherwise designed prior to pumping, or a remainder of an injection treatment can be modified or otherwise designed during pumping. In some implementations, a fracture model can be tied to the information to forward model the response during treatment. As an example, an injection treatment can be designed based on the natural fracture dilation and hydraulic fracture extension pressures and rates, or other information to achieve desirable fracture network geometry. For example, portions of a fracture network that have higher complexity and less fracture extension can be created by using an injection rate below the hydraulic fracture extension pressure. Portions of a fracture network which have more fracture extension and less complexity can be created by using the injection rate above the hydraulic fracture extension pressure. The injection treatment can be designed in another manner or may include various additional or different aspects based on the information obtained from the injection test.

Figure 5:
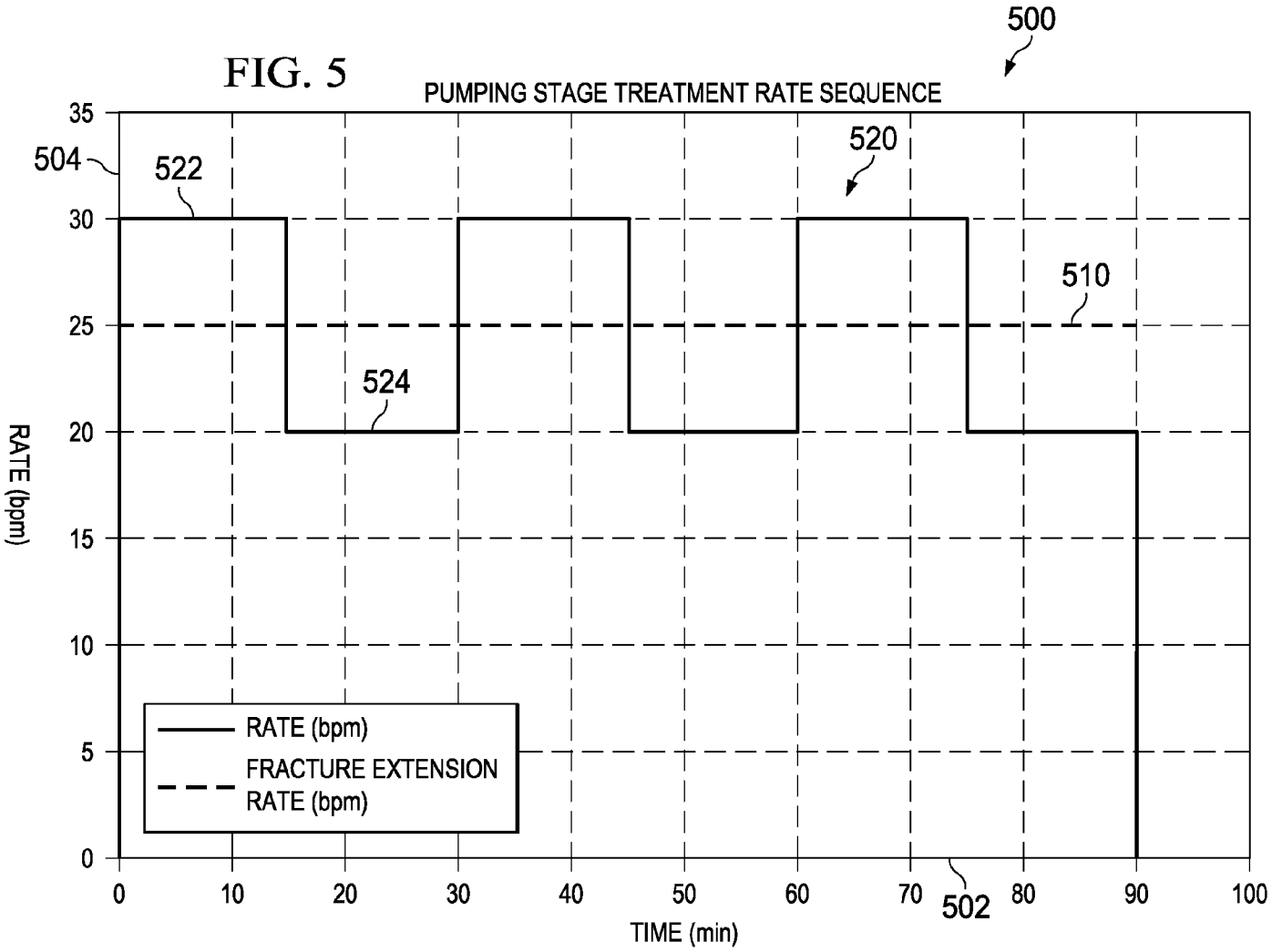
FIG. 5 is a plot showing an injection rate of an example pumping stage sequence.

FIG. 5 is a plot 500 illustrating an injection rate 520 of an example pumping stage sequence for an injection treatment. The injection rate 520 alternates between a first rate (e.g., at 522) above the fracture extension rate 510 and a second rate (e.g., at 524) below the fracture extension rate 510. Here, "fracture extension rate" refers to an injection rate that is associated with fracture extension in the subterranean region. The fracture extension rate can be, for example, a minimum or threshold injection rate that can cause existing fractures to propagate within the subterranean region. The fracture extension rate 510 can be an estimated value, a value derived from injection test data (e.g., the example injection test represented in FIG. 4 or another injection test), a value calculated from geological or structural data, etc.

As shown in the plot 500, the injection rate 520 is initially higher than the fracture extension rate 510, which can reduce near-wellbore issues and extend out into the reservoir. Then the rate 520 is lowered below the fracture extension rate 510, which can generate more fracture complexity. The alternation between the higher rate 522 and the lower rate 524 can then be repeated multiple times, for example, to maximize or otherwise improve a total amount of stimulated reservoir volume, a connected fracture surface area of the fracture network, or another parameter of interest. In some implementations, the pumping stage sequence can be designed to have an initial high rate above the fracture extension rate followed by a low rate below to reduce complexity near the wellbore and then the injection rate is increased in the far field. The pumping sequence can be designed in another manner.

Numerous other types of pumping stage sequences can be designed based on data obtained from the injection test. Some example pumping stage sequences include alternating fluid types. For instance, a low viscosity fluid can be used at one pumping stage to give higher leak off and more complexity and a high viscosity fluid can be used at another pumping stage to give lower leak off and less complexity. The injection test can use the low viscosity fluid and the high viscosity fluid as test injection materials, for example, with varied injection rates to identify the subterranean response to these two fluids. Based on analysis of the subterranean response from the injection test, appropriate rates and pressures at which to pump the two fluids can be determined. In some instances, an example application can include maintaining the appropriate constant rate and switching the fluid types in the pumping stage sequences. Another example can include maintaining a constant injection rate and having pumping stages that alternate between using a fluid with and without a diverter. The diverter can plug the non-dominant fractures and can be used to generate less fracture complexity. Similarly, the injection test can be used to determine the appropriate rates and pressures at which to pump to the fluid with or without the diverter. The injection rates and the injection materials can vary and various combinations of them can be employed in pumping sequence design to achieve one or more desirable fracture properties (e.g., extension, complexity, orientation, spacing, etc.).

Figure 6:
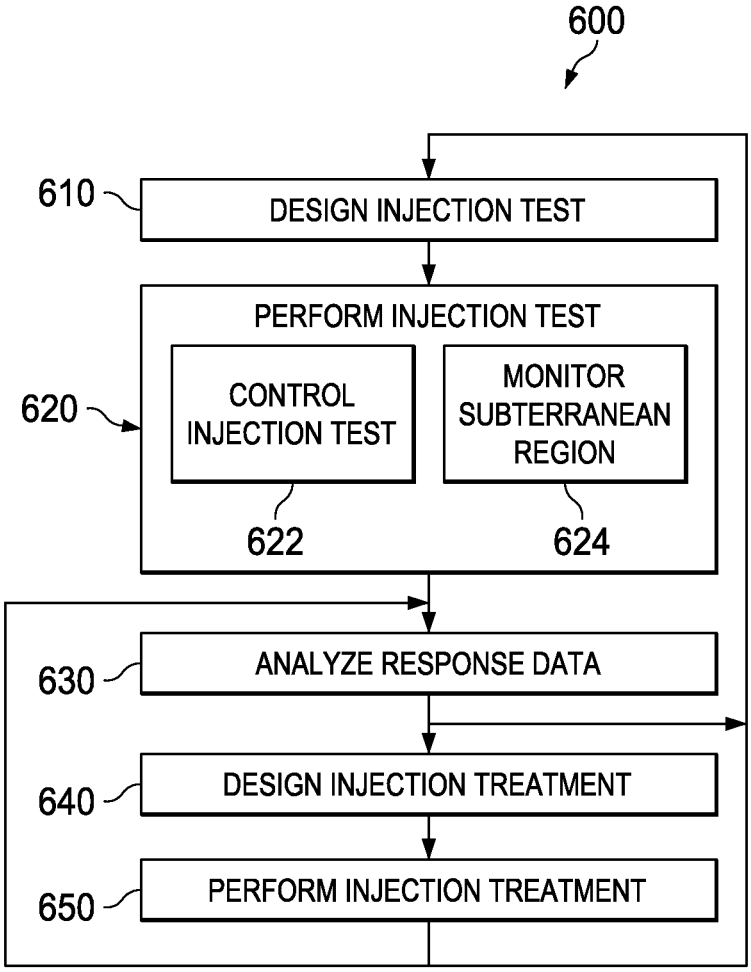
FIG. 6 is a flow chart showing an example process for performing an injection test and an injection treatment.

FIG. 6 is a flow chart showing an example process 600 for performing an injection test and an injection treatment. All or part of the example process 600 may be implemented in a well system, for example, using one or more of the features and attributes of the example well systems 100*a*, 150 shown in FIGS. 1A and 1B, or one or more of the systems 310-340 in the example system architecture 300 shown in FIG. 3. In some cases, aspects of the example process 600 may be performed in a single-well system, a multi-well system, a well system including multiple interconnected wellbores, or in another type of well system, which may include any suitable wellbore orientations. The process 600, individual operations of the process 600, or groups of operations may be iterated, performed apart from the other operations, or performed simultaneously with other operations. In some cases, the process 600 may include the same, additional, fewer, or different operations performed in the same or a different order.

At 610, an injection test is designed. Some example injection tests include injection periods and shut-in intervals. An injection test can include additional or different periods, intervals, stages, or steps. As an example, the injection test can be a stride test that includes a series that alternates between injection periods and shut-in intervals, with each injection period followed by a respective shut-in interval. In some aspects, the injection test can be designed and performed to measure, derive, analyze, or otherwise identify properties of a subterranean region. For example, the injection test can be used for determining ISIP, fracture dilation pressure and rate, fracture extension pressure and rate, fracture closure pressure and rate, or other information of a given formation. In some implementations, the design of an injection test can include determining the injection material and rate for the test. In some instances, the injection test can be designed to create desirable fracture geometry using different injection materials and rates. For example, the injection test can be calibrated (e.g., using specified materials, injection rates, injection durations, etc.) to create reservoir responses of both fracture dilation and fracture extension.

The injection materials can include liquids, gels, proppants, diverters, or combinations of these and other materials. Examples of injection material include: a) water with friction reducer, b) the same fluid to be used in an injection treatment, c) a fluid with or without proppants, d) a fluid with multiple sizes of proppants, e) multiple fluids with different characteristics, f) a linear gel or a cross-linked gel, or a combination of these and other materials. In some aspects, there can be more choices and freedom with the materials pumped during an injection test than with the materials pumped during an actual treatment. The respective injection materials can be the same or different for the multiple injection periods of the injection test.

In some instances, the respective injection rates can be the same or different for the multiple injection periods of the injection test. The injection rate can remain constant or vary within each injection period. In some implementations, the injection rate of the test can be designed such that it starts below a fracture extension pressure and ends above the fracture extension pressure. In some implementations, the injection rate can start with a low value and work up until a high value. The low value and high value can be, for example, default values that can be applied for a variety of materials or formations. In some implementations, with some experience or knowledge of the subterranean region, other starting rates or ending rates can be determined. For example, the starting rate and ending rate can be determined based on adjacent well stages or offset wells, a similar formation, permeability or other properties of the subterranean region, or fluid properties (e.g., viscosity, leak off rate, etc.). For instance, the starting rate can be determined based on a formation matrix rate (e.g., the rate at which the formation begins to accept fluid). The ending rate can be, for example, beyond a fracture extension rate of an adjacent well stage or a wellbore or a similar formation. The injection rate of the injection test can be determined in another manner.

In some instances, the design of the injection test can include specifying or otherwise designing respective durations of the injection periods and shut-in intervals of the injection test. In some implementations, the respective durations can be the same or different across all injection periods and shut-in intervals. As an example, all the injection periods can share one duration while all the shut-in intervals can share another duration. In some instances, the respective durations of the injection periods and the shut-in intervals can be determined, for example, based on the injection rate, the injection material, formation permeability, or other properties of the subterranean region. The duration of the injection periods and shut-in intervals of the injection test can be shorter or longer compared to the duration of a pumping stage in an injection treatment. In some implementations, the durations of the injection periods and shut-in intervals of the injection test can be designed to be as short as possible to allow a timely analysis of the subterranean region and design of an injection treatment.

At 620, the injection test is performed. In some implementations, the injection test can be performed before, during, or after an injection treatment. In some implementations, the injection test is performed, for example, by the example injection test system 310 in FIG. 3 or another system. For example, the injection test can be performed by injecting a specified injection material to the subterranean region at a specified rate for specified durations according to the design at 610. In some implementations, performing the injection test can include controlling the injection test at 622 and monitoring the stimulated subterranean region at 624.

In some implementations, the injection rate for each injection period of the test is controlled by an injection control subsystem or another control system. For instance, controlling the injection rate can include specifying a constant injection rate for each injection period of the test. For example, a low constant injection rate can be specified at an initial injection period and the injection rate can be increased for a subsequent injection period. In some implementations, the injection rate can be increased at least to a point where fracture extension occurs in the subterranean region.

In some implementations, monitoring the subterranean region can include monitoring the injection rate, the pressure response of the subterranean region, or a combination of these and other data. Monitoring can be performed, for example, by receiving and storing data from one or more measurement systems. In some cases, the magnitude and variation of the injection rates and the pressure can be monitored, and the injection rate and the pressure can be plotted, for example, as shown in FIG. 4 or in another manner, for analyzing the subterranean region. Based on the monitored pressure response, the injection test can be adjusted or otherwise controlled to produce certain types of events or conditions. For example, the injection rate and the duration of each injection period can be controlled such that the pressure reaches a stabilized slope such as the constant slopes 412 and 414 shown in FIG. 4. In some implementations, the duration of the shut-in period can be controlled such that the pressure declines to a certain level where an ISIP can be determined. The injection rate can be controlled in another manner.

At 630, response data can be analyzed. In some implementations, the response data is analyzed, for example, by the example analysis system 320 in FIG. 3 or another computing system. The response data can be acquired, for example, by sensors or other detecting equipment of a well system during the injection test. The response data can include the response data of the subterranean region to the injection test. The response data can include pressure data, microseismic data, temperature data, or any other data from the subterranean region. The response data can be received during the monitoring operation at 624 or the response data can be received at another time. In some implementations, the subterranean region can be analyzed based on the response data. Various formation properties of the subterranean region can be identified, extracted, derived, or otherwise analyzed based on, for example, the injection rates, the pressure response, the injection material, or other data. For instance, a fracture extension pressure can be identified based on the pressure response, for example, based on a slope change of a pressure response curve. The ISIP can be identified based on the pressure response associated with the shut-in intervals of the injection test. Other types of information, for example, natural fracture extension pressure, fracture closure pressure, fracture re-opening pressure, near wellbore or perforation restrictions, in-situ stresses, fluid loss, leak off rate, etc. can be identified or otherwise analyzed, for example, based on the example techniques described with respect to FIG. 4 or in another manner.

In some instances, based on the analysis of the response data at 630, the example process 600 may go back to 610 to modify or redesign the injection test. For instance, an injection rate or a duration of an injection period can be increased or decreased to test the subterranean response to different injection rates. A shut-in interval can be extended or shortened to find an optimal or otherwise proper duration to obtain formation properties (e.g., ISIP, wellbore friction, etc.). The material properties (e.g., a type, a volume, a size, or a concentration, etc.) can be changed to learn the subterranean response to different injection materials. Additional or different aspects of an injection test can be modify or otherwise redesigned.

At 640, an injection treatment is generated, modified, or otherwise designed. In some implementations, the injection treatment can be designed based on the analysis of the response data of the subterranean region to the injection test. In some implementations, the injection treatment is designed, for example, by the example design system 330 in FIG. 3 or another computing system. In some instances, designing an injection treatment can include designing a pumping sequence, a treatment plan, or other aspects of the injection treatment. For example, a respective injection rate, injection material, and duration for each pumping stage of the pumping stage sequence can be selected or otherwise designed. In some implementations, the design of the pumping sequence can depend on the properties of the subterranean region analyzed based on the test data at 630, a desired fracture property (e.g., complexity, extension, orientation, stimulated reservoir volume, etc.), or other information. The pumping stages can be designed based on the techniques described with respect to FIG. 5, or the pumping stages can be designed in another manner.

For instance, the pumping stages can be designed such that the injection rate alternates between a first injection rate and a second injection rate. In some instances, the first injection rate can be selected, for example, to increase the fracture extension and can be above a fracture extension pressure. The second injection rate can be selected, for example, to increase the fracture complexity and can be below the fracture extension pressure. In some instances, the pumping stages can be designed such that the injection material alternates between a first injection material and a second, different injection material. For example, the first injection material can include a diverter while the second injection material does not; or the first injection material can include a type of proppant while the second material does not; or the first injection material can include a type of fluid (e.g., a low viscosity fluid for creating higher leak off and more complexity) while the second material can include another type of fluid (e.g., a high viscosity fluid for generating lower leak off and less complexity). The first injection material and the second material can differ in, for example, flow volume, proppant or diverter type, size, and concentrations, or other properties. Additional or different injection rates and injection materials can be specified or otherwise designed.

At 650, an injection treatment is performed. The injection treatment can be performed, for example, by the example treatment system 340 in FIG. 3 or another treatment system. In some instances, the injection treatment can be performed according to the injection treatment designed at 640 or in another manner. In some implementations, performing an injection treatment can include controlling an injection rate, an injection material, or both of a pumping stage, for example, as specified in the injection treatment design. In some cases, controlling an injection rate can include switching the injection rate among two or more rates. For example, controlling the injection rate can include increasing the injection rate to a rate (e.g., a rate above the fracture extension rate) to induce fracture extension, or decreasing the injection rate to another rate (e.g., a rate below the fracture extension rate and above the fracture dilation rate) to induce fracture dilation and generate more fracture complexity. The alternation of the injection rates can be repeated or varied until the fracture network achieves a desired geometry. In some cases, controlling an injection material can include switching the injection material among two or more materials to generate more or less leak off and complexity. Additional or different operations can be performed for the injection treatment.

In some implementations, the injection treatment can be updated or modified in real time or dynamically, for example, based on response data from an injection test during the injection treatment. In some implementations, the injection treatment and the injection test can be performed in the same wellbore, or the injection treatment can be performed in an adjacent, or a remote wellbore relative to the injection test. In some implementations, the injection treatment can be performed at one stage of a multi-stage injection treatment while the injection test can be performed at the same or a different stage of the multi-stage injection treatment. The injection test can be performed before or during the injection treatment. The injection treatment can be modified or designed prior to pumping or the remainder of the injection treatment can be modified or designed during pumping. The injection test and the injection treatment can be performed in another manner.

In some instances, the subterranean region can be monitored during the injection treatment. For example, the pressure response, stimulated fracture geometry (e.g., extension, orientation, complexity, etc.), and other subterranean responses can be monitored. Whether to modify the injection treatment can be determined based on the monitoring. For instance, whether to modify the injection treatment can depend on whether the hydraulic fracture grows along a desired direction, whether the fracture dilation or extension is needed, or any other monitored information. In some instances, modifying the injection treatment can include modifying an instantaneous injection treatment parameter (e.g., pumping pressure of the hydraulic fracturing fluid, injection rate, injection material, fracture diversion, fracture or perforation spacing between treatment stages, etc.). In some implementations, the remainder of the treatment or a prospective injection schedule (e.g., injection schedules of future treatment stages etc.) can be modified.

In some cases, modifying the injection rate can include, for example, increasing the injection rate to a rate above a fracture extension pressure to generate more fracture extension, or decreasing the injection rate to another rate below the fracture extension pressure to create more fracture complexity. In some instances, modifying the injection material can include one or more of changing an injection fluid, adding or subtracting a proppant, adding or subtracting a diverter, or other operations. For example, the injection fluid type can be changed from a low viscosity type to a high viscosity type, gelling agents can be added to increase viscosity, diverters can be added to plug non-dominant fractures, or a combination of these and other operations can be performed to generate more fracture extension and less fracture complexity. Conversely, the injection fluid type can be changed from a high viscosity type to a low viscosity type, gelling agents can be removed to decrease viscosity, diverters can be removed, or a combination of these and other operations can be performed to generate more fracture complexity and less fracture extension. Additional or different modifications can be made to the injection treatment to impact or otherwise control the growth of hydraulic fractures in the subterranean region. In some implementations, the modification can be performed in real time on location with or without input from a technical professional.

In some instances, the response of the subterranean region to the injection treatment can be monitored and the response data from the injection treatment can be collected and analyzed at 630. Based on the analysis of the response data at 630, the example process 600 may proceed to 610 to modify or otherwise design an injection test. In some cases, the example process 600 may proceed to 640 to modify or otherwise design the injection treatment. In some implementations, one or more operations of the example process 600 can be automated processes that allow a timely modification, design, and execution of an injection test or an injection treatment. In some implementations, the subterranean region can be continuously monitored and analyzed to maintain an accurate subterranean analysis and to learn the subterranean region over time. Based on the analysis of the subterranean response to the injection treatment or the quick injection test, the injection treatment can be updated, modified, or otherwise designed in real time or dynamically, to ensure an effective injection treatment design that fits for the current subterranean region and helps optimize the productivity of the subterranean region.

In some implementations, some or all of the operations in the process 600 are executed in real time during an injection treatment. An operation can be performed in real time, for example, by performing the operation in response to receiving data (e.g., from a sensor or monitoring system) without substantial delay. An operation can be performed in real time, for example, by performing the operation while monitoring for additional data from the injection treatment. Some real time operations can receive an input and produce an output during an injection treatment; in some instances, the output is made available (e.g., to a user or another system) within a time frame that allows a response to the output, for example, by modifying the injection treatment.

In some implementations, some or all of the operations in the process 600 are executed dynamically during a fracture treatment. An operation can be executed dynamically, for example, by iteratively or repeatedly performing the operation based on additional inputs, for example, as the inputs are made available. In some instances, dynamic operations are performed in response to receiving response data from an injection test or treatment.

Some embodiments of subject matter and operations described in this specification can be implemented in digital electronic circuitry, or in computer software, firmware, or hardware, including the structures disclosed in this specification and their structural equivalents, or in combinations of one or more of them. Some embodiments of subject matter described in this specification can be implemented as one or more computer programs, i.e., one or more modules of computer program instructions, encoded on a computer storage medium for execution by, or to control the operation of, data processing apparatus. A computer storage medium can be, or can be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (e.g., multiple CDs, disks, or other storage devices).

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, or declarative or procedural languages. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

Some of the processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and processors of any kind of digital computer. Generally, a processor will receive instructions and data from a read only memory or a random access memory or both. A computer includes a processor for performing actions in accordance with instructions and one or more memory devices for storing instructions and data. A computer may also include, or be operatively coupled to receive data from or transfer data to, or both, one or more mass storage devices for storing data, e.g., magnetic, magneto optical disks, or optical disks. However, a computer need not have such devices. Devices suitable for storing computer program instructions and data include all forms of non-volatile memory, media and memory devices, including by way of example semiconductor memory devices (e.g., EPROM, EEPROM, flash memory devices, and others), magnetic disks (e.g., internal hard disks, removable disks, and others), magneto optical disks, and CD ROM and DVD-ROM disks. The processor and the memory can be supplemented by, or incorporated in, special purpose logic circuitry.

To provide for interaction with a user, operations can be implemented on a computer having a display device (e.g., a monitor, or another type of display device) for displaying information to the user and a keyboard and a pointing device (e.g., a mouse, a trackball, a tablet, a touch sensitive screen, or another type of pointing device) by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

A computing system can include computers that are remote from each other and interact through a communication network. Examples of communication networks include a local area network ("LAN") and a wide area network ("WAN"), an inter-network (e.g., the Internet), a network comprising a satellite link, and peer-to-peer networks (e.g., ad hoc peer-to-peer networks). A relationship of client and server may arise, for example, by virtue of computer programs running on the respective computers and having a client-server relationship to each other.

While this specification contains many details, these should not be construed as limitations on the scope of what may be claimed, but rather as descriptions of features specific to particular examples. Certain features that are described in this specification in the context of separate implementations can also be combined. Conversely, various features that are described in the context of a single implementation can also be implemented in multiple embodiments separately or in any suitable subcombination.

A number of embodiments have been described. Nevertheless, it will be understood that various modifications can be made. Accordingly, other embodiments are within the scope of the following claims.

The invention claimed is:

1. A subterranean region testing method comprising:

controlling an injection rate of an injection test applied to a subterranean region, the injection test comprising a time series of injection periods and shut-in intervals, each of the injection periods temporally followed by a respective one of the shut-in intervals, wherein controlling the injection rate comprises:

maintaining a first constant injection rate during a first injection period;

maintaining a shut-in interval between the first injection period and a second subsequent injection period; and maintaining a second, different constant injection rate during the second injection period;

monitoring the subterranean region during the injection test;

receiving response data from an injection test of a subterranean region, the response data comprising pressure data reflecting pressure response of the subterranean region to the injection test, the response data being acquired during a time series of injection periods and shut-in intervals of the injection test, each of the injection periods temporally followed by a respective one of the shut-in intervals, the response data comprising respective data corresponding to each of the series of injection periods and shut-in intervals; and analyzing the subterranean region based on the response data, wherein analyzing the subterranean region based on the response data includes analyzing the subterranean region based on a combination of the respective data corresponding to each of the series of injection periods and shut-in intervals.

2. The method of claim 1, wherein monitoring the subterranean region comprises monitoring the subterranean region during the injection periods and shut-in intervals of the injection test.

3. The method of claim 1, wherein monitoring the subterranean region comprises monitoring the pressure response of the subterranean region to the injection test.

4. The method of claim 1, wherein controlling the injection rate comprises maintaining a constant injection rate during each respective injection period.

5. The method of claim 1, wherein the second constant injection rate is greater than the first constant injection rate.

6. The method of claim 1, wherein controlling the injection rate comprises increasing the injection rate at least to a point where fracture extension occurs in the subterranean region.

7. The method of claim 1, comprising designing the injection test.

8. The method of claim 7, wherein designing the injection test comprises selecting an injection rate for each injection period.

9. The method of claim 7, wherein designing the injection test comprises selecting a duration of each injection period and each shut-in interval of the injection test.

10. The method of claim 7, wherein designing the injection test comprises selecting an injection material for the injection test.

11. The method of claim 10, wherein the injection material includes one or more of a fluid, a proppant, or a diverter.

12. The method of claim 1, wherein analyzing the subterranean region comprises identifying a fracture extension pressure based on the pressure response.

13. The method of claim 12, wherein identifying the fracture extension pressure comprises identifying the fracture extension pressure based on a change of a slope in a pressure response curve.

14. The method of clam 1, wherein analyzing the subterranean region comprises identifying an instantaneous shut-in pressure (ISIP) based on the pressure response.

15. The method of claim 14, wherein identifying the ISIP comprises identifying the ISIP based on the response data associated with the shut-in intervals of the injection test.

16. A well system comprising:

an injection control subsystem operable to control an injection rate of an injection test applied to a subterranean region, the injection test including a time series of injection periods and shut-in intervals, each of the injection periods temporally followed by a respective one of the shut-in intervals, wherein the injection control subsystem operable to:

maintain a first constant injection rate during a first injection period;

maintain a shut-in interval between the first injection period and a second subsequent injection period; and maintain a second, different constant injection rate during the second injection period;

a monitoring subsystem operable to monitor the subterranean region during the injection test; and a computing subsystem operable to:

receive response data from an injection test of a subterranean region, the response data comprising pressure data reflecting a pressure response of the subterranean region to the injection test, the response data being acquired during a time series of injection periods and shut-in intervals of the injection test, each of the injection periods temporally followed by a respective one of the shut-in intervals, the response data comprising respective data corresponding to each of the series of injection periods and shut-in intervals; and analyze the subterranean region based on the response data, wherein analyzing the subterranean region based on the response data includes analyzing the subterranean region based on a combination of the respective data corresponding to each of the series of injection periods and shut-in intervals.

17. The well system of claim 16, the monitoring subsystem being operable to monitor the subterranean region during the injection periods and shut-in intervals of the injection test.

18. The well system of claim 16, the monitoring subsystem being operable to monitor the pressure response of the subterranean region to the injection test.

19. The well system of claim 16, wherein controlling the injection rate comprises maintaining a respective constant injection rate during each injection period.

20. The well system of claim 16, wherein controlling the injection rate comprises increasing the injection rate across the series of the injection periods.

21. The well system of claim 16, comprising a computing subsystem operable to design the injection test.

22. The well system of claim 21, the computing subsystem operable to select an injection material and injection rates for the injection test.

* * * * *